US009565496B2

(12) United States Patent
Konno et al.

(10) Patent No.: US 9,565,496 B2
(45) Date of Patent: Feb. 7, 2017

(54) SOUND REPRODUCTION DEVICE

(75) Inventors: Fumiyasu Konno, Osaka (JP); Katsu Takeda, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 288 days.

(21) Appl. No.: 14/233,974

(22) PCT Filed: Aug. 28, 2012

(86) PCT No.: PCT/JP2012/005397
§ 371 (c)(1),
(2), (4) Date: Jan. 21, 2014

(87) PCT Pub. No.: WO2013/042317
PCT Pub. Date: Mar. 28, 2013

(65) Prior Publication Data

US 2014/0161278 A1 Jun. 12, 2014

(30) Foreign Application Priority Data

Sep. 22, 2011 (JP) ..... 2011-206922

(51) Int. Cl.
*H04R 3/04* (2006.01)
*H04R 5/04* (2006.01)
*H04R 17/10* (2006.01)

(52) U.S. Cl.
CPC *H04R 3/04* (2013.01); *H04R 5/04* (2013.01); *H04R 17/10* (2013.01); *H04R 2217/03* (2013.01)

(58) Field of Classification Search
CPC ..... H04R 2217/03; H04R 3/04; H04R 5/04; H04R 17/10
(Continued)

(56) References Cited

U.S. PATENT DOCUMENTS 4,868,445 A 9/1989 Wand
5,068,903 A * 11/1991 Walker ..... H04R 3/04 381/59
(Continued)

FOREIGN PATENT DOCUMENTS

CN 1476667 2/2004
CN 102172043 8/2011
(Continued)

OTHER PUBLICATIONS

Norris, Elwood G. "Improved Amplification Systems Carrier Tracking Systems and Related Methods for use in Parametric Sound Systems", U.S. Appl. No. 61/585,112, filed Jan. 10, 2012, pp. 1-10.*
(Continued)

*Primary Examiner* — Davetta W Goins
*Assistant Examiner* — Daniel Sellers
(74) *Attorney, Agent, or Firm* — McDermott Will & Emery LLP

(57) ABSTRACT

A sound reproduction device includes a modulator having an output terminal for outputting a modulated carrier wave signal obtained by modulating a carrier wave signal in a ultrasonic band with an audible sound signal, a super-directivity loudspeaker connected to the output terminal, a capacitor connected between a ultrasonic wave source and a ground, first and second current detectors for detecting currents flowing through the super-directivity loudspeaker and the capacitor, a high-pass filter for outputting a filtered signal obtained by eliminating a low-frequency band component of the current detected by the first current detector, and a differential amplifier unit for outputting a signal corresponding to a difference between the filtered signal and the current detected by the second current detector. The ultrasonic wave source is configured to output the carrier
(Continued)

wave signal such that the signal output from the differential amplifier unit is constant.

10 Claims, 6 Drawing Sheets

(58) Field of Classification Search
USPC ..... 381/59, 94.2
See application file for complete search history.

(56) References Cited

U.S. PATENT DOCUMENTS

| | | | | |
|---|---|---|---|---|
| 5,542,001 | A * | 7/1996 | Reiffin | H04R 3/002 381/400 |
| 6,445,804 | B1 | 9/2002 | Hirayanagi | |
| 2001/0007591 | A1 | 7/2001 | Pompei | |
| 2001/0039389 | A1 | 11/2001 | Sakurai et al. | |
| 2003/0199793 | A1 | 10/2003 | Sakurai et al. | |
| 2004/0017921 | A1 * | 1/2004 | Mantovani | H03G 5/22 381/94.9 |
| 2004/0047477 | A1 | 3/2004 | Bank et al. | |
| 2004/0162509 | A1 | 8/2004 | Sakurai et al. | |
| 2008/0175404 | A1 | 7/2008 | Bank et al. | |
| 2011/0188672 | A1 | 8/2011 | Tada et al. | |
| 2014/0044283 | A1 * | 2/2014 | Norris | H04B 11/00 381/103 |

FOREIGN PATENT DOCUMENTS

| | | | |
|---|---|---|---|
| EP | 0 973 152 | A2 | 1/2000 |
| EP | 2 334 098 | A1 | 6/2011 |
| JP | 05-153788 | A | 6/1993 |
| JP | 11-164383 | A | 6/1999 |
| JP | 2001-346805 | A | 12/2001 |
| JP | 2002-354573 | A | 12/2002 |
| JP | 2006-173850 | A | 6/2006 |
| JP | 2006-245731 | A | 9/2006 |

OTHER PUBLICATIONS

Supplementary European Search Report mailed Jan. 27, 2015, issued in counterpart European Patent Application No. 12834212.8; 7 pages.

International Search Report issued in International Application No. PCT/JP2012/005397 with Date of mailing Dec. 11, 2012, with English Translation.

English Translation of Chinese Search Report dated Feb. 14, 2016 for the related Chinese Patent Application No. 201280046242.3.

* cited by examiner

SOUND REPRODUCTION DEVICE

RELATED APPLICATIONS

This application is the U.S. National Phase under 35 U.S.C. §371 of International Application No. PCT/JP2012/005397, filed on Aug. 28, 2012, which in turn claims the benefit of Japanese Application No. 2011-206922, filed on Sep. 22, 2011, the disclosures of which Applications are incorporated by reference herein.

TECHNICAL FIELD

The present invention relates to a sound reproduction device that uses a super-directivity loudspeaker.

BACKGROUND ART

Sound reproduction devices transmitting sound information only to certain target audiences by using loudspeakers capable of providing the sound information with directivity. FIG. 6 is a schematic diagram of sound reproduction device 500 disclosed in Patent Literature 1.

Carrier wave selector 101 selects a single frequency out of plural frequencies of ultrasonic wave carrier signals, and outputs the selected frequency signal to ultrasonic wave oscillator 103. Ultrasonic wave oscillator 103 oscillates and outputs a carrier wave signal with the frequency to carrier wave modulator 105. On the other hand, reproduction signal generator 107 for reproducing audible sound outputs an audible sound signal to carrier wave modulator 105. Carrier wave modulator 105 modulates the carrier wave signal with the audible sound signal, and outputs the modulated carrier wave signal. The modulated carrier wave signal is input to ultrasonic loudspeaker 109. Ultrasonic loudspeaker 109 emits sound having directivity in response to the modulated carrier wave signal.

An operation of sound reproduction device 500 will be described below. FIG. 7A shows audible sound signal 111 reproduced by reproduction signal generator 107. FIG. 7B shows carrier wave signal 113 generated by ultrasonic wave oscillator 103. FIG. 7C shows modulated carrier wave signal 115 generated by carrier wave modulator 105. Carrier wave modulator 105 produces modulated carrier wave signal 115 by modulating carrier wave signal 113 with audible sound signal 111. In modulated carrier wave signal 115, the period of carrier wave signal 113 is changed according to amplitude of audible sound signal 111. As shown in FIG. 7C, modulated carrier wave signal 115 has a waveform having the period changes partially and having constant amplitude. Ultrasonic loudspeaker 109 has a diaphragm having a piezoelectric element attached thereto. Modulated carrier wave signal 115 input to the piezoelectric element of ultrasonic loudspeaker 109 causes the diaphragm to vibrate and generate rarefactions and compressions in the air, thereby outputting an ultrasonic wave of modulated carrier wave signal 115 to the atmosphere from ultrasonic loudspeaker 109. When this ultrasonic wave reaches ears of a user, the user can capture only compressional vibrations of the air in an audible band since the user cannot hear the compressional vibrations in an ultrasonic band. Here, the ultrasonic wave propagates with directivity of a narrow angle since modulated carrier wave signal 115 output from ultrasonic loudspeaker 109 has frequencies in the ultrasonic band. The user of sound reproduction device 500 can hence hear the audible sound only within a narrow area within which modulated carrier wave signal 115 propagates.

In sound reproduction device 500, ultrasonic loudspeaker 109 is driven with constant amplitude, as shown in FIG. 7C. If sound reproduction device 500 is used for a long period of time under such a condition, the frequency and amplitude of modulated carrier wave signal 115 may fluctuate due to heat-up of the piezoelectric element of ultrasonic loudspeaker 109 and changes in the ambient temperature. This fluctuation may change the sound pressure reproduced by sound reproduction device 500 and cause sound quality to deteriorate.

CITATION LIST

Patent Literature

Patent Literature 1: Japanese Patent Laid-Open Publication No. 2006-245731

SUMMARY

A sound reproduction device includes an ultrasonic wave source for outputting a carrier wave signal in an ultrasonic band, a modulator having an output terminal for outputting a modulated carrier wave signal obtained by modulating the carrier wave signal with an audible sound signal, a super-directivity loudspeaker including a piezoelectric element and a diaphragm driven by the piezoelectric element in which the piezoelectric element is connected electrically between the output terminal of the modulator and a ground, a first current detector for detecting a current flowing through the piezoelectric element, a capacitor connected electrically between the ultrasonic wave source and the ground, a second current detector for detecting a current flowing through the capacitor, a high-pass filter for outputting a filtered signal obtained by eliminating a low-frequency band component of the current detected by the first current detector, and a differential amplifier unit for outputting a signal corresponding to a difference between the current detected by the second current detector and the filtered signal. The ultrasonic wave source is configured to output the carrier wave signal such that the signal output from the differential amplifier unit is constant.

This sound reproduction device can reduce deterioration of sound quality even is temperature changes.

DETAIL DESCRIPTION OF PREFERRED EMBODIMENTS

Exemplary Embodiment 1

Figure 1A:
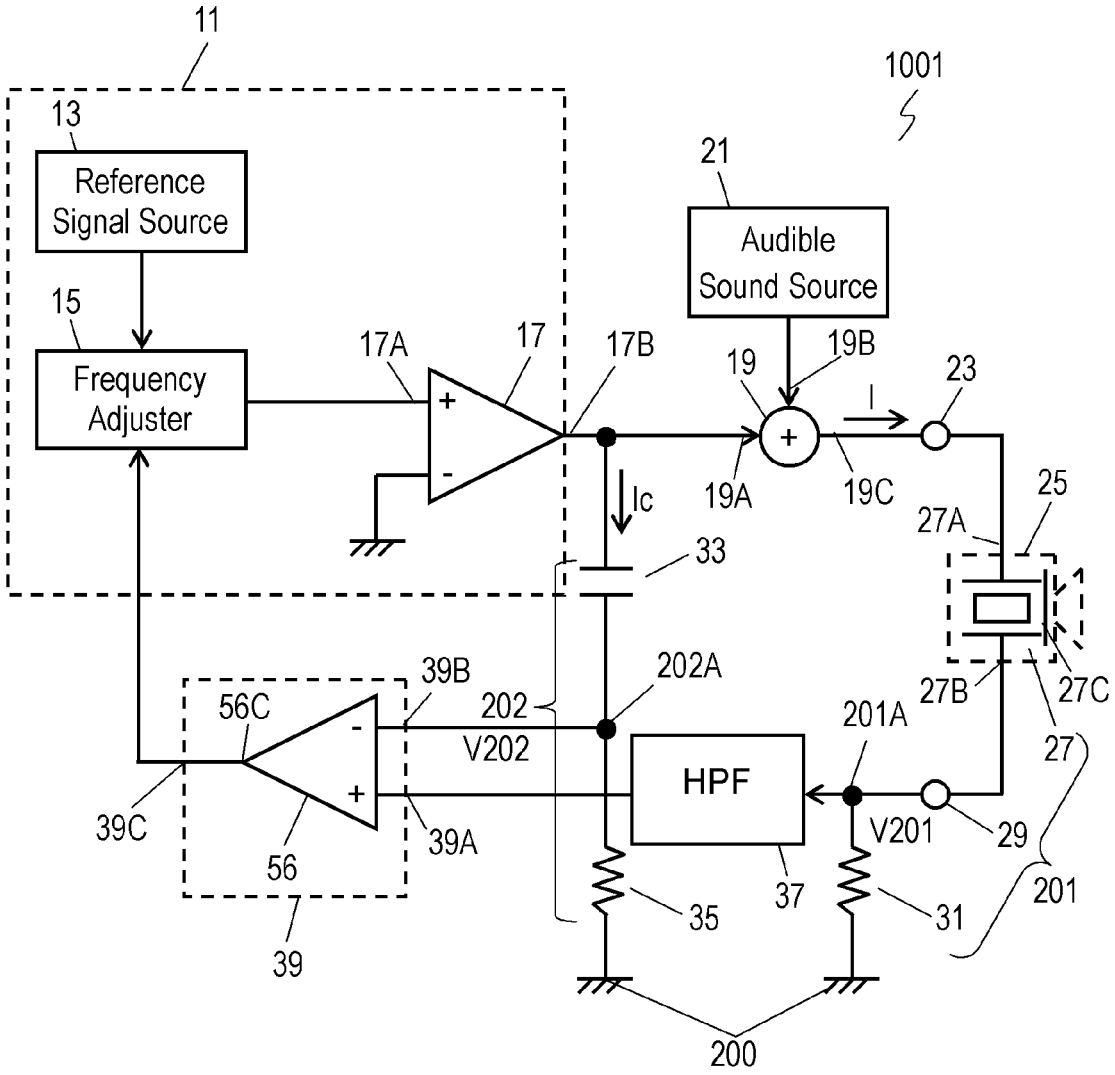
FIG. 1A is a circuit block diagram of a sound reproduction device according to Exemplary Embodiment 1 of the present invention.
Figure 1B:
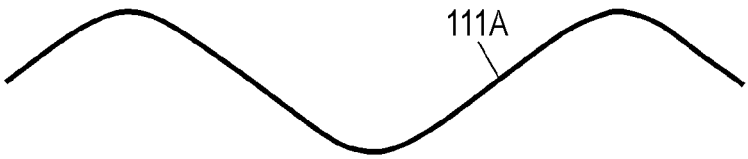
FIG. 1B shows an audible sound signal generated by an audible sound source of the sound reproduction device according to Embodiment 1.
Figure 1C:
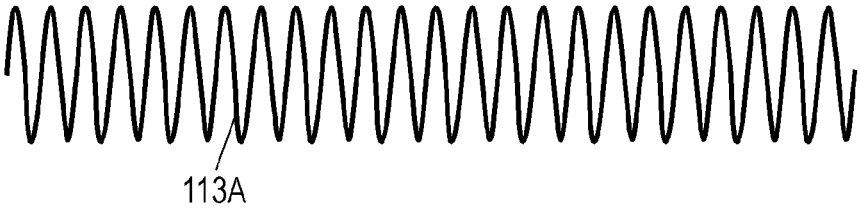
FIG. 1C shows a carrier wave signal generated by an ultrasonic wave source of the sound reproduction device according to Embodiment 1.
Figure 1D:
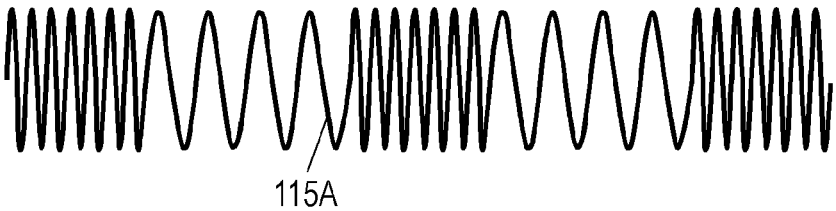
FIG. 1D shows a modulated carrier wave signal generated by a modulator of the sound reproduction device according to Embodiment 1.

FIG. 1A is a circuit block diagram of sound reproduction device 1001 according to Exemplary Embodiment 1 of the present invention. FIGS. 1B to FIG. 1D show signals of sound reproduction device 1001. Sound reproduction device 1001 includes ultrasonic wave source 11, modulator 19, audible sound source 21, super-directivity loudspeaker 25, current detectors 31 and 35, high-pass filter (HPF) 37, and differential amplifier unit 39. Ultrasonic wave source 11 is configured to output a carrier wave signal having a frequency in an ultrasonic band, and includes reference signal source 13 for generating and outputting a reference frequency, frequency adjuster 15 connected electrically to reference signal source 13, and amplifier 17 connected to frequency adjuster 15. Based on the reference frequency, frequency adjuster 15 outputs a carrier wave signal having a frequency in the ultrasonic band that is necessary to drive piezoelectric element 27 of super-directivity loudspeaker 25. The carrier wave signal output from frequency adjuster 15 is supplied to input terminal 17A of amplifier 17 to be amplified by amplifier 17. The amplified carrier wave signal is supplied from output terminal 17B of amplifier 17 to input terminal 19A of modulator 19. FIG. 1C shows a waveform of carrier wave signal 113A generated by ultrasonic wave source 11.

Modulator 19 is also connected electrically to audible sound source 21 that outputs audible sound signal 111A having a frequency in an audible band, as shown in FIG. 1B. Therefore, the audible sound signal is also input to input terminal 19B of modulator 19. Modulator 19 modulates the carrier wave signal with the audible sound signal, and outputs modulated carrier wave signal 115A shown in FIG. 1D from output terminal 19C.

The modulated carrier wave signal output from modulator 19 is electrically connected to positive electrode 27A of piezoelectric element 27 built in super-directivity loudspeaker 25 through positive terminal 23 of super-directivity loudspeaker 25. In addition, negative electrode 27B of piezoelectric element 27 is electrically connected to ground 200 through negative terminal 29 of super-directivity loudspeaker 25 and current detector 31. To put such a structure in other words, piezoelectric element 27 of super-directivity loudspeaker 25 is connected in series to current detector 31 at node 201A to constitute series circuit 201. Series circuit 201 is connected electrically between modulator 19 and ground 200. Current detector 31 is configured to detect current I that flows to super-directivity loudspeaker 25, and is implemented by, e.g. a shunt resistor or a Hall element. According to Embodiment 1, a shunt resistor suitable for downsizing is used as current detector 31.

Super-directivity loudspeaker 25 further includes diaphragm 27C attached to piezoelectric element 27. Diaphragm 27C vibrates in accordance with vibration of piezoelectric element 27. When the modulated carrier wave signal output from modulator 19 is input to piezoelectric element 27, piezoelectric element 27 transfers the vibrations in response to the modulated carrier wave signal to diaphragm 27C of super-directivity loudspeaker 25. As a result, an ultrasonic wave having the waveform shown in FIG. 1D is emitted from super-directivity loudspeaker 25. When this ultrasonic wave reaches ears of a user, the user can capture only compressional vibrations of the air in the audible band since the user cannot hear the compressional vibrations in the ultrasonic band. Here, the ultrasonic wave output from super-directivity loudspeaker 25 propagates with directivity of a narrow angle. Thus, the user can hear the audible sound only within a narrow range in which the ultrasonic wave propagates while the user cannot hear the audible sound outside of the range.

Capacitor 33 is connected in series to current detector 35 at node 202A to constitute series circuit 202. Series circuit 202 is connected electrically between output terminal 17B of amplifier 17 and ground 200. Capacitance Cc of capacitor 33 is equal to capacitance Cp of piezoelectric element 27. Capacitance Cc of capacitor 33 is equal to capacitance Cp of piezoelectric element 27 within variations and tolerances. In addition, temperature characteristics of capacitance Cp matches with temperature characteristics of capacitance Cc. The temperature characteristics of capacitance Cp matches with the temperature characteristic of capacitance Cc within variations and tolerances. Current detector 35 is configured to detect capacitor current Ic that flows through capacitor 33, and is implemented by a shunt resistor, similarly to current detector 31.

Differential amplifier unit 39 has input terminals 39A and 39B and output terminal 39C. Differential amplifier unit 39 includes differential amplifier 56. Differential amplifier 56 has output terminal 56C for outputting a difference between signals input from input terminals 39A and 39B. Output terminal 39C of differential amplifier unit 39 is connected to output terminal 56C of differential amplifier 56. Input terminal 39A of differential amplifier unit 39 is electrically connected via high-pass filter 37 to negative terminal 29 of super-directivity loudspeaker 25, i.e., to node 201A at which piezoelectric element 27 is connected to current detector 31 of series circuit 201. High-pass filter 37 eliminates components in a low frequency band (i.e., audible sound signal components) from the modulated carrier wave signal. High-pass filter 37 thus outputs a voltage proportional to a current of the carrier wave signal flowing to piezoelectric element 27, as a filtered signal, and this voltage is input to input terminal 39A of differential amplifier unit 39.

On the other hand, node 202A at which capacitor 33 is connected to current detector 35 of series circuit 202 is connected electrically to input terminal 39B of differential amplifier unit 39. Therefore, a voltage proportional to capacitor current Ic is input to input terminal 39B of differential amplifier unit 39.

Differential amplifier 56 of differential amplifier unit 39 includes an operational amplifier and peripheral circuit components. Output terminal 39C of differential amplifier unit 39 is electrically connected to frequency adjuster 15 of ultrasonic wave source 11.

An operation of sound reproduction device 1001 will be described below. The operation of obtaining the modulated carrier wave signal by modulating the carrier wave signal with the audible sound signal by modulator 19, and emitting the sound wave from super-directivity loudspeaker 25 has been described above, other operations will be described.

The frequency of the carrier wave signal is determined to be at or near a resonant frequency of piezoelectric element 27 of super-directivity loudspeaker 25 in order to efficiently emit the sound wave. Reference signal source 13 therefore outputs substantially the resonant frequency of piezoelectric element 27.

When piezoelectric element 27 of super-directivity loudspeaker 25 is driven continuously at this resonant frequency, piezoelectric element 27 produces heat due to an internal impedance of piezoelectric element 27. This heat is caused by an electro-mechanical conversion loss near the resonant frequency within piezoelectric element 27. This will be detailed below.

Figure 2:
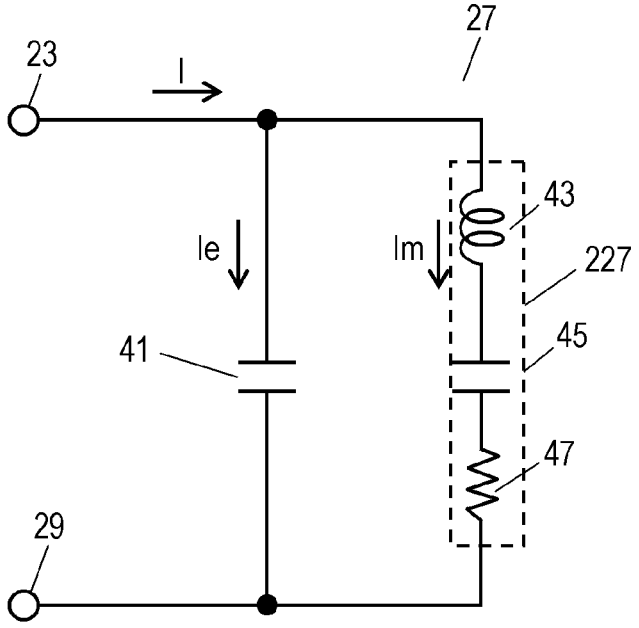
FIG. 2 is an equivalent circuit diagram of a piezoelectric element of the sound reproduction device near a resonance point thereof according to Embodiment 1.

FIG. 2 shows an equivalent circuit of piezoelectric element 27 near the resonant frequency. Piezoelectric element 27 has a structure of a capacitor that includes piezoelectric element capacitance 41. In this equivalent circuit, series circuit 227 including inductive component 43, capacitive component 45, and resistive component 47 which are connected in series is connected in parallel to piezoelectric element capacitance 41, particularly at or near the resonant frequency. The heat is therefore produced due to the total impedance of series circuit 227, that is, the internal impedance of piezoelectric element 27 at or near the resonant frequency. Current I flowing into piezoelectric element 27 is divided into piezoelectric-element capacitance current Ie that flows to piezoelectric element capacitance 41 and electro-mechanical conversion current Im that flows to series circuit 227. Electro-mechanical conversion current Im that flows to series circuit 227 produces the electro-mechanical conversion loss by the impedance of series circuit 227, and causes the heat to evolve due to this electro-mechanical conversion loss.

Deterioration in the sound quality caused by this heat will be described below.

Figure 3:
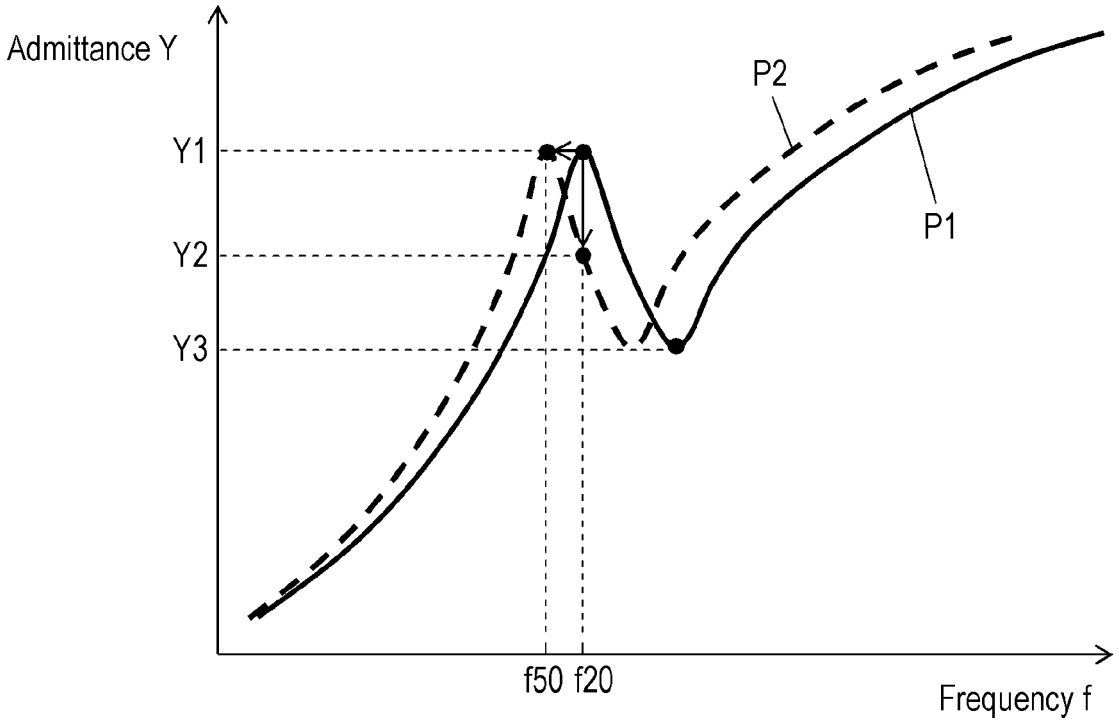
FIG. 3 is a frequency characteristic chart of an admittance of a super-directivity loudspeaker of the sound reproduction device according to Embodiment 1.

FIG. 3 shows a relation between frequency f for driving piezoelectric element 27 of super-directivity loudspeaker 25, and admittance Y that is the reciprocal of the internal impedance. In FIG. 3, the horizontal axis represents frequency f and the vertical axis represents admittance Y. In FIG. 3, profile P1 shows a frequency characteristic of admittance Y of piezoelectric element 27 at a temperature of 20° C., and profile P2 shows another frequency characteristic of admittance Y of piezoelectric element 27 at a temperature of 50° C.

Admittance Y increases with an increase of frequency f until admittance Y reaches a locally maximum point at admittance Y1, decreases from the locally maximum point (Y1) to a locally minimum point at admittance Y3, and increases again, as shown in FIG. 3. Here, frequency f at the locally maximum point (Y1) is the resonant frequency of piezoelectric element 27. Frequency f20 at the locally maximum point (Y1) of profile P1 is the resonant frequency of piezoelectric element 27 when the temperature of piezoelectric element 27 is 20° C. The internal impedance decreases near frequency f20 at the locally maximum point since admittance Y1 is large, and increases electro-mechanical conversion current Im accordingly. Electro-mechanical conversion current Im is proportional to amplitude of diaphragm 27C attached to piezoelectric element 27 when piezoelectric element 27 emits a sound wave according to the modulated carrier wave signal. Therefore, the amplitude and the sound pressure increase due to the sound wave near the resonant frequency (i.e., frequency f20 at the locally maximum point) of piezoelectric element 27.

On the other hand, heat (i.e., electro-mechanical conversion loss) is produced in piezoelectric element 27 since electro-mechanical conversion current Im increases near the resonant frequency. This is because an amount of the heat is proportional to the square of the electro-mechanical conversion current Im. As a result, the temperature of piezoelectric element 27 rises when piezoelectric element 27 is driven continuously near the resonant frequency. Admittance Y of piezoelectric element 27 shifts to profile P2 shown in FIG. 3 when the temperature of piezoelectric element 27 rises up to 50° C. In this case, admittance Y decreases suddenly to admittance Y2 of profile P2 at the frequency f20 if piezoelectric element 27 continues to be driven at frequency f20. The decreasing of the admittance decreases electro-mechanical conversion current Im decreases due to an increase of the impedance, accordingly decreasing the amplitude of the diaphragm 27C. This decreases a sound pressure, and provides deterioration of the sound quality due to the change of the temperature. In addition, the resonant frequency decreases from frequency f20 at the locally maximum point of the profile P1 to frequency f50 at the locally maximum point of the profile P2 when the temperature of piezoelectric element 27 rises to 50° C.

This deterioration of the sound quality can be reduced by preventing the amplitude of diaphragm 27C from changing significantly even when the temperature of piezoelectric element 27 rises. Since the amplitude is proportional to electro-mechanical conversion current Im, as described above, the amplitude of diaphragm 27C can remain unchanged by controlling amplitude of electro-mechanical conversion current Im to cause the amplitude to be constant even when the temperature of piezoelectric element 27 rises.

Sound reproduction device 1001 according to Embodiment 1 is configured to perform feedback control with frequency adjuster 15 to adjust the frequency of the carrier wave signal according to a change of electro-mechanical conversion current Im. However, electro-mechanical conversion current Im is not detectable separately from piezoelectric-element capacitance current Ie since current Im is a part of the current in the equivalent circuit shown in FIG. 2. In sound reproduction device 1001 shown in FIG. 1A, voltage V201 at the node 201A between piezoelectric element 27 and current detector 31 of series circuit 201 corresponds to current I detected by current detector 31. On the other hand, voltage V202 at the node 202A between capacitor 33 and current detector 35 of series circuit 202 corresponds to capacitor current Ic detected by current detector 35.

Since capacitance Cc of capacitor 33 is equal to capacitance Cp of piezoelectric element capacitance 41 in piezoelectric element 27 shown in FIG. 2 (i.e., capacitance Cc of capacitor 33 is equal to capacitance Cp of piezoelectric element capacitance 41 in piezoelectric element 27 within ranges of variations and tolerances), as described above, capacitor current Ic detected by current detector 35 is equal to piezoelectric-element capacitance current Ie. Upon having voltage V201 corresponding to the electric current I detected by current detector 31 and voltage V202 corresponding to the capacitor electric current Ic detected by current detector 35 input to input terminal 39A and input terminal 39B of differential amplifier unit 39, respectively, output terminal 39C of differential amplifier unit 39 outputs a voltage corresponding to a difference obtained by subtracting the capacitor current Ic from the current I, or the electro-mechanical conversion current Im.

Current I contains the audible sound signal input from audible sound source 21. In order to reduce an influence of the audible sound signal, voltage V201 corresponding to the current I detected by current detector 31 passes through high-pass filter 37 to remove a component corresponding to the audible sound signal from voltage V201. In this configuration, the voltage corresponding to the current I and having the influence of the audible sound signal reduced is input to differential amplifier unit 39. This increases accuracy in a value of electro-mechanical conversion current Im output from differential amplifier unit 39.

The output of differential amplifier unit 39 is input to frequency adjuster 15 of ultrasonic wave source 11. On the other hand, the output from reference signal source 13 is also input to frequency adjuster 15. These outputs allow frequency adjuster 15 to adjust the reference frequency in the ultrasonic band (e.g., frequency f20 at the locally maximum point) to be output from reference signal source 13 according to the output of differential amplifier unit 39, and outputs the adjusted frequency as a frequency of the carrier wave signal. To be specific, admittance Y1 at frequency f20 of the locally maximum point decreases as an increase of the temperature of piezoelectric element 27, as described with reference to FIG. 3, and accordingly, decreases electro-mechanical conversion current Im that corresponds to the output of differential amplifier unit 39. Therefore, the amplitude of electro-mechanical conversion current Im is made constant in order to make the amplitude of diaphragm 27C constant even when the temperature of piezoelectric element 27 rises. For this purpose, the admittance Y is increased to admittance Y1, as shown in FIG. 3. When the temperature of piezoelectric element 27 rises to, e.g. 50° C., frequency adjuster 15 adjusts frequency f of the carrier wave signal to frequency f50 of the locally maximum point.

To summarize the above operation, frequency adjuster 15 adjusts to decrease frequency f of the carrier wave signal when the output of differential amplifier unit 39 deceases. This operation maintains the amplitude of electro-mechanical conversion current Im to be constant at any time by such feedback control. In other words, frequency adjuster 15 of ultrasonic wave source 11 adjusts the frequency of the carrier wave signal to make the output of differential amplifier unit 39 constant.

As a result, variations in the sound pressure decrease and deterioration in the sound quality can be reduced since the amplitude of diaphragm 27C becomes constant irrespective of a change of the temperature of piezoelectric element 27. Deterioration of the sound quality is reduced due to high-pass filter 37 increasing the accuracy of electro-mechanical conversion current Im output from differential amplifier unit 39, as mentioned above.

As described, audible sound source 21 is configured to output an audible sound signal. Ultrasonic wave source is configured to output a carrier wave signal in an ultrasonic band. Modulator 19 has an output terminal for outputting a modulated carrier wave signal obtained by modulating the carrier wave signal with the audible sound signal. Super directivity loudspeaker includes piezoelectric element 27 and diaphragm driven 27C by piezoelectric element 27. Piezoelectric element 27 is connected electrically between output terminal 19C of modulator 19 and ground 200. Current detector 31 is configured to detect a current flowing through piezoelectric element 27. Capacitor 33 is connected electrically between ultrasonic wave source 11 and ground 200. Current detector 35 is configured to detect a current flowing through capacitor 33. High-pass filter 37 is configured to output a filtered signal obtained by eliminating a low-frequency band component of the current detected by current detector 31. Differential amplifier unit 39 includes differential amplifier 56 for outputting a difference between the filtered signal and the current detected by current detector 35, and is configured to output a signal corresponding to the output difference. Ultrasonic wave source 11 is configured to output the carrier wave signal such that the signal output from differential amplifier unit 39 is constant. According to Embodiment 1, the signal output from the differential amplifier unit is the difference output from the differential amplifier. Ultrasonic wave source 11 is configured to output the carrier wave signal such that the difference output from differential amplifier 56 is constant.

Piezoelectric element 27 of super-directivity loudspeaker 25 is connected in series to current detector 31 at node 201A to constitute series circuit 201. Series circuit 201 is connected electrically between output terminal 19C of modulator 19 and ground 200. Capacitor 33 is connected in series to current detector 35 at node 202A to constitute series circuit 202A. Series circuit 202 is connected electrically between ultrasonic wave source 11 and ground 200. Differential amplifier 56 has input terminal 39A connected to node 201A, and input terminal 39B connected to node 202A.

With the above configuration and operation, electro-mechanical conversion current Im is obtained based on the current I of piezoelectric element 27 that changes when the temperature changes due to heat-up of piezoelectric element 27. Ultrasonic wave source 11 adjusts the frequency f of the carrier wave signal to make electro-mechanical conversion current Im constant, that is, to make the sound pressure constant, thereby providing sound reproduction device 1001 capable of reducing deterioration of the sound quality.

According to Embodiment 1, the temperature characteristic of capacitance Cp of piezoelectric element 27 is equal to capacitance Cc of capacitor 33. That is, the temperature characteristic of capacitance Cp of piezoelectric element 27 is equal to the temperature characteristic of capacitance Cc of capacitor 33 within ranges of variations and tolerances. These temperature characteristics may not necessarily be equal to each other in the case that sound reproduction device 1001 is used in an environment having an ambient temperature substantially constant.

Exemplary Embodiment 2

Figure 4:
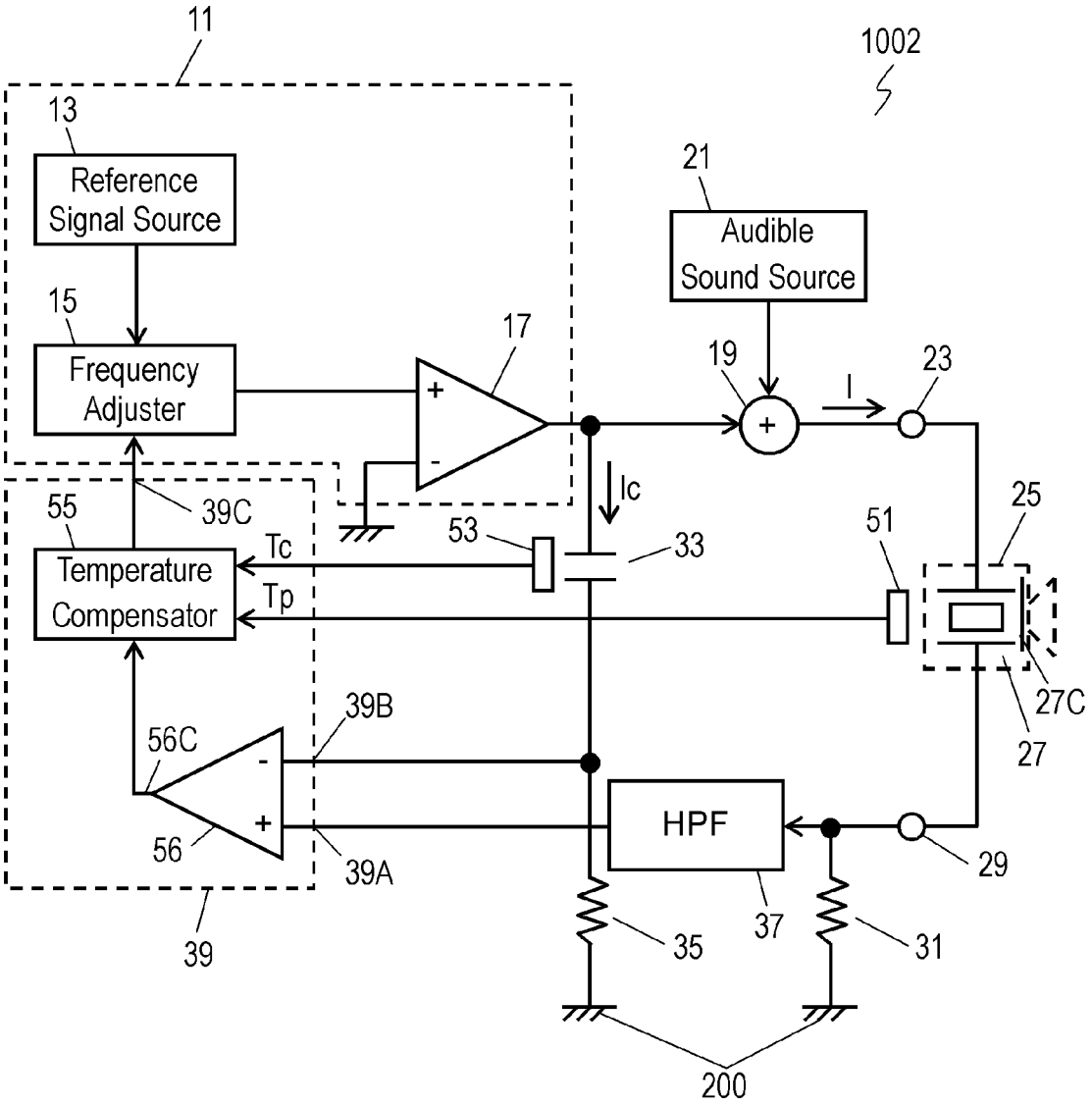
FIG. 4 is a circuit block diagram of a sound reproduction device according to Exemplary Embodiment 2 of the invention.

FIG. 4 is a circuit block diagram of sound reproduction device 1002 according to Exemplary Embodiment 2 of the present invention. In FIG. 4, components identical to those of sound reproduction device 1001 according to Embodiment 1 shown in FIG. 1A are denoted by the same reference numerals. Sound reproduction device 1002 according to Embodiment 2 further includes temperature sensors 51 and 53, and temperature compensator 55.

Temperature sensor 51 is disposed as close to piezoelectric element 27 of super-directivity loudspeaker 25 as possible. Temperature sensor 51 outputs an ambient temperature around super-directivity loudspeaker 25, while the ambient temperature of super-directivity loudspeaker 25 is substantially equal to an ambient temperature around piezoelectric element 27 since piezoelectric element 27 is installed into super-directivity loudspeaker 25. An output of temperature sensor 51 is piezoelectric element temperature Tp that is the ambient temperature of piezoelectric element 27.

Temperature sensor 53 is disposed as close to capacitor 33 as possible. Temperature sensor 53 outputs capacitor temperature Tc that is an ambient temperature around capacitor 33.

Differential amplifier unit 39 further includes temperature compensator 55. In detail, temperature compensator 55 is connected electrically between output terminal 56C of differential amplifier 56 and ultrasonic wave source 11. Differential amplifier unit 39 further includes peripheral circuit components built therein similar the unit to Embodiment 1. Temperature compensator 55 is also connected electrically to temperature sensors 51 and 53.

Each of temperature sensors 51 and 53 is implemented by a thermistor having a resistance changing at a large rate sensitively to a temperature. However, temperature sensors 51 and 53 are necessarily be implemented not by thermistors, but by other types of temperature sensors, such as thermocouples.

Sound reproduction device 1002 operates in a manner as described next. In the following descriptions, detailed explanation will be omitted for same operations as those of sound reproduction device 1001 in the first embodiment, and descriptions will be focused specifically on the operations of temperature sensors 51 and 53 and temperature compensators 55.

Temperature compensator 55 stores predetermined values of output correction amount ΔIh for differential amplifier 56 corresponding to two variables, piezoelectric element temperature Tp and capacitor temperature Tc. Temperature compensator 55 retrieves output correction amount ΔIh of a value according to piezoelectric element temperature Tp obtained from an output of temperature sensor 51 and capacitor temperature Tc obtained from an output of temperature sensor 53, and performs temperature compensation by correcting an output of differential amplifier 56 with output correction amount ΔIh.

An operation of the temperature compensation will be detailed below.

Capacitance Cp of piezoelectric element 27 has a temperature characteristic that is dependent on piezoelectric element temperature Tp, i.e., the ambient temperature of piezoelectric element 27. According to Embodiment 2, capacitance Cp decreases as an increase of piezoelectric element temperature Tp.

Similarly, capacitance Cc of capacitor 33 has a temperature characteristic that is dependent on capacitor temperature Tc, i.e., the ambient temperature of capacitor 33. According to Embodiment 2, capacitance Cc decreases as an increase of capacitor temperature Tc.

In sound reproduction device 1001 according to Embodiment 1, the temperature characteristics of capacitance Cp and capacitance Cc are equal with each other (i.e., the temperature characteristics of capacitance Cp and capacitance Cc are equal to each other within their ranges of variations and tolerances). Therefore, even when the ambient temperatures of capacitor 33 and piezoelectric element 27 change, differential amplifier 56 can cancel out the changes of capacitances Cp and Cc caused by the changes of the temperature, and provides an output corresponding only to electro-mechanical conversion current Im, therefore not requiring temperature compensator 55.

In the case that the temperature characteristics of capacitance Cp and capacitance Cc are different, however, the output corresponding to electro-mechanical conversion current Im of sound reproduction device 1001 according to Embodiment 1 contains an error caused by the change of the ambient temperature. When the ambient temperature changes, this error influences the adjustment operation according to Embodiment 1 for making the sound pressure constant, hence reducing deterioration of the sound quality insufficiently.

In sound reproduction device 1002 according to Embodiment 2, temperature sensors 51 and 53 detect piezoelectric element temperature Tp and capacitor temperature Tc respectively, so that temperature compensator 55 corrects the output of differential amplifier 56 based on a correlation with output correction amount ΔIh corresponding to temperatures Tp and Tc.

The correlation of output correction amount ΔIh for differential amplifier 56 corresponding to the two variables, i.e., piezoelectric element temperature Tp and capacitor temperature Tc will be described below.

This correlation can be obtained as follows. First, piezoelectric element temperature Tp and capacitor temperature Tc are changed independently within a temperature range usable of sound reproduction device 1002 and also within a range of structure-dependent variations in the temperature of the sound reproduction device in a maximum temperature gradient when the ambient temperature changes. An output of differential amplifier 56 is then obtained at an early stage of sound reproduction while piezoelectric element 27 does not heat up for various values of piezoelectric element temperature Tp and capacitor temperature Tc, and this output is stored as output correction amount ΔIh. Since the above is to obtain output correction amount ΔIh even under a condition in which piezoelectric element temperature Tp and capacitor temperature Tc are different due to locations of piezoelectric element 27 and capacitor 33 and a condition of heat dissipation during the course of changing the ambient temperature, the above correlation can be determined experimentally including the structure-dependent variations in the temperature of the sound reproduction device. This correlation is stored in temperature compensator 55, so that output correction amount ΔIh can be obtained by detecting piezoelectric element temperature Tp and capacitor temperature Tc.

Alternately, this correlation may be obtained by performing a simulation according to an ambient temperature and a temperature gradient while changing the ambient temperature based on the circuit configuration shown in FIG. 4, the equivalent circuit shown in FIG. 2, and temperature characteristics of piezoelectric element 27 and capacitor 33.

Temperature compensator 55 obtains output correction amount ΔIh corresponding to piezoelectric element temperature Tp and capacitor temperature Tc by using the correlation determined as discussed above.

Differential amplifier unit 39 provides a difference obtained by subtracting output correction amount ΔIh from an output of differential amplifier 56, and supplies the difference through output terminal 39C. Temperature compensator 55 performs temperature compensation to the output of differential amplifier 56 according to the temperatures of piezoelectric element 27 and capacitor 33, and outputs the compensated output as a signal from output terminal 39C of differential amplifier unit 39 to frequency adjuster 15 of ultrasonic wave source 11. Frequency adjuster 15 adjusts the carrier wave signal based on the temperature-compensated output of differential amplifier unit 39, and reduces the influence of the ambient temperature, thereby reducing of deterioration of the sound quality accordingly.

As described above, in sound reproduction device 1002 according to Embodiment 2, temperature sensor 51 is disposed to super-directivity loudspeaker 25. Temperature sensor 53 is disposed to capacitor 33. Differential amplifier unit 39 includes temperature compensator 55 for compensating a difference that is output from differential amplifier 56 according to the temperatures detected by temperature sensors 51 and 53. According to Embodiment 2, the signal output from differential amplifier unit 39 is the difference compensated by temperature compensator 55. Ultrasonic wave source 11 outputs a carrier wave signal such that the difference compensated by temperature compensator 55 is constant.

The above configuration and operation allow a sound wave to be emitted from super-directivity loudspeaker 25 with a constant sound pressure even when the ambient temperature changes, in addition to changes in the temperature caused by the heat generated by piezoelectric element 27, thereby providing sound reproduction device 1002 capable of reducing deterioration of the sound quality.

Exemplary Embodiment 3

Figure 5:
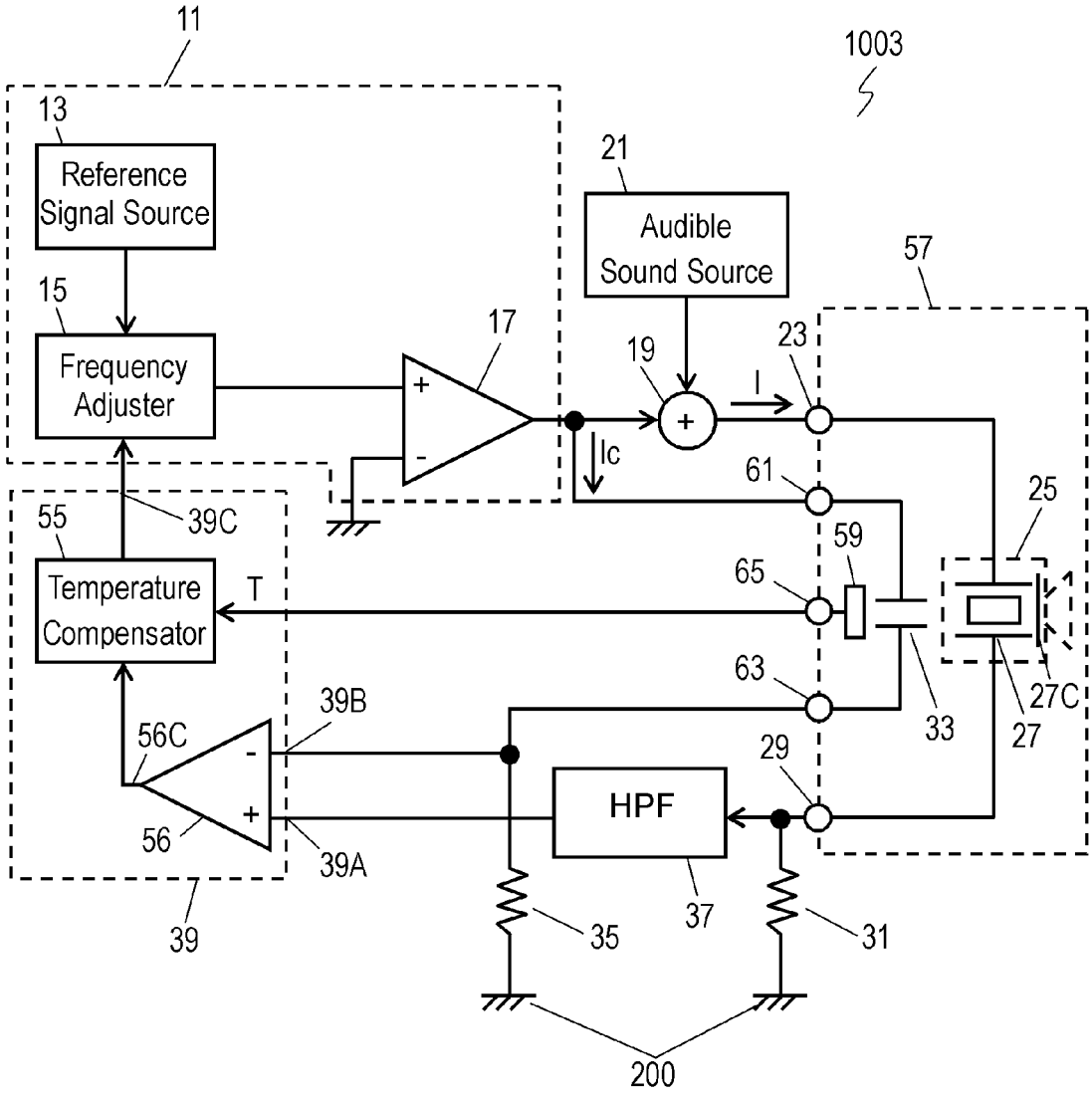
FIG. 5 is a circuit block diagram of a sound reproduction device according to Exemplary Embodiment 3 of the invention.
Figure 6:
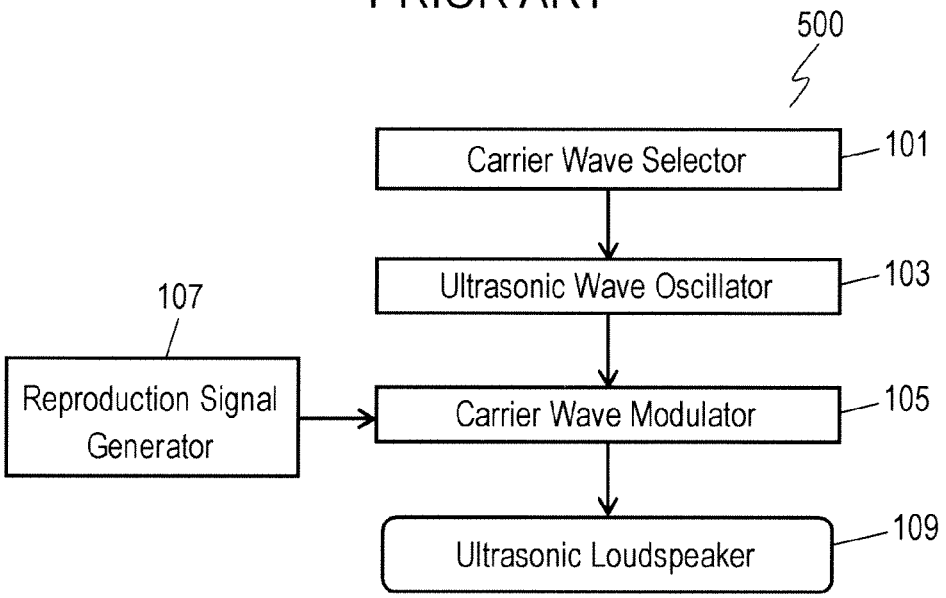
FIG. 6 PRIOR ART
FIG. 6 is a schematic diagram of a conventional sound reproduction device.
Figure 7A:
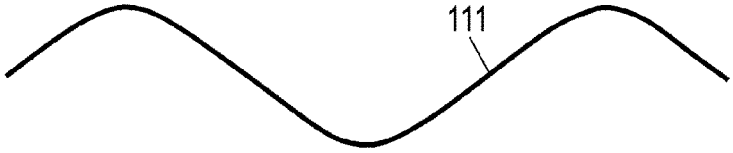
FIG. 7A PRIOR ART
FIG. 7A shows an audible sound signal generated by a reproduction signal generator of the conventional sound reproduction device.
Figure 7B:
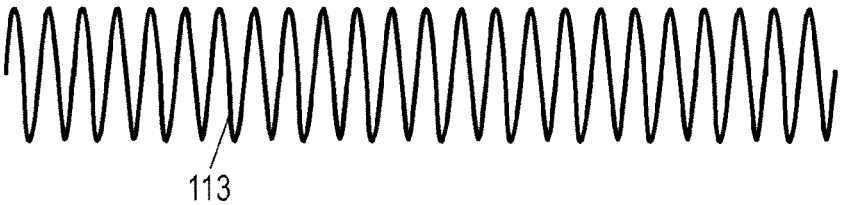
FIG. 7B PRIOR ART
FIG. 7B shows a carrier wave signal generated by an ultrasonic wave oscillator of the conventional sound reproduction device.
Figure 7C:
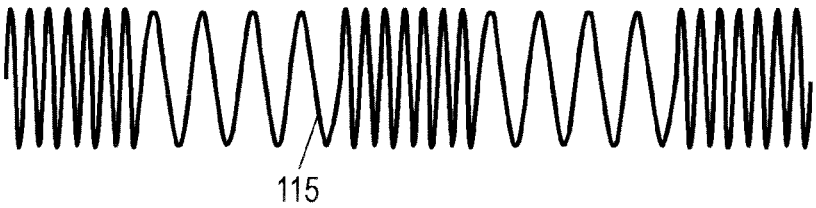
FIG. 7C PRIOR ART
FIG. 7C is shows a modulated carrier wave signal generated by a carrier wave modulator of the conventional sound reproduction device.

FIG. 5 is a circuit block diagram of sound reproduction device 1003 according to Exemplary Embodiment 3 of the present invention. In FIG. 5, components identical to as those of sound reproduction devices 1001 and 1002 according to Embodiments 1 and 2 shown in FIGS. 1A and 4.

In sound reproduction device 1003 according to Embodiment 3, super-directivity loudspeaker 25 and capacitor 33 are mounted on same single circuit board 57. Both super-directivity loudspeaker 25 and capacitor 33 are disposed as close to each other as possible.

Temperature sensor 59 is disposed to circuit board 57. Temperature sensor 59 is disposed at a position as close to both super-directivity loudspeaker 25 and capacitor 33 as possible on circuit board 57. Super-directivity loudspeaker 25 and capacitor 33 are located close to each other and mounted on the same circuit board 57 to be thermally coupled through circuit board 57, thereby causing temperatures of super-directivity loudspeaker 25 and capacitor 33 to be similar to each other. Temperature sensor 59 hence detects a temperature (hereinafter referred to as ambient temperature T) of piezoelectric element 27 built in super-directivity loudspeaker 25 and capacitor 33.

An output of temperature sensor 59 is electrically connected to temperature compensator 55. Thus, only one temperature sensor 59 is connected with temperature compensator 55.

Positive terminal 23 and negative terminal 29 of super-directivity loudspeaker 25 are provided on circuit board 57. In addition, circuit board 57 has positive capacitor terminal 61 connected to a positive electrode of capacitor 33, negative capacitor terminal 63 connected to a negative electrode of capacitor 33, and temperature sensor terminal 65 connected to temperature sensor 59 mounted thereon.

Structures other than above are identical to sound reproduction device 1002 according to Embodiment 2 shown in FIG. 4.

Similar to temperature sensors 51 and 53 according to Embodiment 2, a thermistor may be used as temperature sensor 59.

An operation of sound reproduction device 1003 will be described below. In the following descriptions, detailed explanation will be omitted for same operations as those of Embodiment 1, and descriptions will be focused on temperature compensator 55 that operates according to an output of temperature sensor 59, which represents a distinctive feature of the operation.

Temperature compensator 55 stores predetermined values of output correction amount ΔIh for differential amplifier 56 corresponding to a variable, that is, ambient temperature T. Temperature compensator 55 retrieves output correction amount ΔIh of a value in accordance with ambient temperature T obtained from an output of temperature sensor 59, and performs temperature compensation by correcting an output of differential amplifier 56 with output correction amount ΔIh.

An operation of this temperature compensation will be detailed below. In sound reproduction device 1003 according to Embodiment 3, the temperature characteristic of capacitance Cp of piezoelectric element 27 is different from the temperature characteristic of capacitance Cc of capacitor 33, as described in Embodiment 2. When the ambient temperature changes, a resultant error influences the adjustment operation for making the sound pressure constant, as in sound reproduction device 1001 of Embodiment 1, hence reducing deterioration of the sound quality insufficiently.

In sound reproduction device 1003 according to Embodiment 3, temperature compensator 55 corrects an output of differential amplifier 56 based on a correlation with output correction amount ΔIh corresponding to ambient temperature T. Here, since super-directivity loudspeaker 25, capacitor 33 and temperature sensor 59 are disposed close to one another on the same circuit board 57 as described above, their temperatures become nearly equal. Unlike sound reproduction device 1002 according to Embodiment 2, the temperature of piezoelectric element 27 built into super-directivity loudspeaker 25 and the temperature of capacitor 33 are equal to ambient temperature T detected by temperature sensor 59 in sound reproduction device 1003 according to Embodiment 3.

The correlation of output correction amount ΔIh of differential amplifier 56 corresponding to ambient temperature T will be described below.

This correlation can be obtained by detecting ambient temperature T with temperature sensor 59 while maintaining the entire sound reproduction device 1003 at a certain temperature, and an output of differential amplifier 56 at an early stage of sound reproduction that does not cause piezoelectric element 27 to heat up is taken as output correction amount ΔIh. The above correlation can be determined experimentally by obtaining a value of output correction amount ΔIh, i.e., the output of differential amplifier 56 at various values of ambient temperature T. The correlation can therefore be obtained more easily than sound reproduction device 1002 according to Embodiment 2. This correlation is stored in temperature compensator 55, so that output correction amount ΔIh can be retrieved by detecting ambient temperature T.

Alternatively, this correlation may be obtained for various values of ambient temperature T by performing a simulation based on the circuit configuration shown in FIG. 5, the equivalent circuit shown in FIG. 2, and temperature characteristics of piezoelectric element 27 and capacitor 33.

Temperature compensator 55 obtains output correction amount ΔIh corresponding to ambient temperature T by using the correlation determined as discussed above, and subtracts output correction amount ΔIh from an output of differential amplifier 56. As mentioned, temperature compensator 55 performs temperature compensation to the output of differential amplifier 56 according to the temperature of piezoelectric element 27 and capacitor 33 which is ambient temperature T, and outputs the compensated output from output terminal 39C of differential amplifier unit 39 to frequency adjuster 15 of ultrasonic wave source 11. Since frequency adjuster 15 adjusts the carrier wave signal based on the temperature-compensated output of differential amplifier unit 39, the influence of the ambient temperature T is reduced, hence further reducing deterioration of the sound quality.

In sound reproduction device 1003 according to Embodiment 3, super directivity loudspeaker 25 and capacitor 33 are mounted on circuit board 57. Temperature sensor 59 is mounted on circuit board 57. Differential amplifier unit 39 includes temperature compensator 55 for compensating a difference output from differential amplifier 56 according to the temperature detected by temperature sensor 59. According to Embodiment 3, a signal output from differential amplifier unit 39 is the difference that has been compensated by temperature compensator 55, so that ultrasonic wave source 11 may output the carrier wave signal such that the difference compensated by temperature compensator 55 is constant.

With the above configuration and operation, the sound wave can be emitted from super-directivity loudspeaker 25 with a constant sound pressure even when the ambient temperature T changes, in addition to changes in the temperature caused by the heat generated by piezoelectric element 27, thereby providing sound reproduction device 1003 capable of reducing deterioration of the sound quality. Super-directivity loudspeaker 25, capacitor 33, and temperature sensor 59 are disposed close to one another on the same circuit board 57, only one temperature sensor 59 is needed. This can also simplify processes of temperature compensation with temperature compensator 55 since the correlation for obtaining output correction amount ΔIh from one variable, i.e., ambient temperature T can be simplified. Thus, sound reproduction device 1003 according to Embodiment 3 has an advantage of simplifying the configuration more than sound reproduction device 1002 according to Embodiment 2.

In Embodiment 3, super-directivity loudspeaker 25, capacitor 33, and temperature sensor 59 are mounted on the same circuit board 57, some or all of other circuit components may be mounted on circuit board 57. This configuration provides sound reproduction device 1003 with a small size.

INDUSTRIAL APPLICABILITY

A sound reproduction device according to the present invention can reduce deterioration of sound quality caused by a temperature of a piezoelectric element, hence being useful as the sound reproduction device equipped with a super-directivity loudspeaker for reproducing a sound signal directed to a particular listener.

REFERENCE MARKS IN THE DRAWINGS

11 Ultrasonic Wave Source
19 Modulator
21 Audible Sound Source
25 Super-Directivity Loudspeaker
27 Piezoelectric Element
27C Diaphragm
31 Current Detector (First Current Detector)
33 Capacitor
35 Current Detector (Second Current Detector)
37 High-Pass Filter
39 Differential Amplifier Unit
51 Temperature Sensor (First Temperature Sensor)
53 Temperature Sensor (Second Temperature Sensor)
55 Temperature Compensator
56 Differential Amplifier
57 Circuit Board
59 Temperature Sensor

The invention claimed is:

1. A sound reproduction device comprising:
an ultrasonic wave source for outputting a carrier wave signal in an ultrasonic band;
a modulator having an output terminal for outputting a modulated carrier wave signal obtained by modulating the carrier wave signal with an audible sound signal;
a super-directivity loudspeaker including a piezoelectric element and a diaphragm driven by the piezoelectric element, the piezoelectric element being connected electrically between the output terminal of the modulator and a ground;
a first current detector for detecting a current flowing through the piezoelectric element;
a capacitor connected electrically between the ultrasonic wave source and the ground;
a second current detector for detecting a current flowing through the capacitor;
a high-pass filter for outputting a filtered signal obtained by eliminating a low-frequency band component of the current detected by the first current detector; and
a differential amplifier unit including a differential amplifier for outputting a difference between the filtered signal and the current detected by the second current detector, the differential amplifier unit being configured to output a signal corresponding to the output difference,
wherein an equivalent circuit of the piezoelectric element includes a series circuit and a piezoelectric element capacitance connected in parallel with the series circuit, the series circuit including a resistive component, an inductive component, and a capacitive component connected in series,
wherein a capacitance of the capacitor is substantially equal to a capacitance of the piezoelectric element capacitance, and
wherein the ultrasonic wave source is configured to output the carrier wave signal such that the signal output from the differential amplifier unit is constant.

2. The sound reproduction device according to claim 1,
wherein the piezoelectric element of the super-directivity loudspeaker is connected in series to the first current detector at a first node to constitute a first series circuit,
wherein the first series circuit is connected electrically between the output terminal of the modulator and the ground,
wherein the capacitor is connected in series to the second current detector at a second node to constitute a second series circuit,
wherein the second series circuit is connected electrically between the ultrasonic wave source and the ground, and
wherein the differential amplifier has a first input terminal connected to the first node, and a second input terminal connected to the second node.

3. The sound reproduction device according to claim 1, wherein the signal output from the differential amplifier unit is the difference output from the differential amplifier.

4. The sound reproduction device according to claim 1, further comprising:
a first temperature sensor disposed to the super-directivity loudspeaker; and
a second temperature sensor disposed to the capacitor, wherein the differential amplifier unit further includes a temperature compensator for compensating the difference output from the differential amplifier based on a temperature detected by the first temperature sensor and a temperature detected by the second temperature sensor, and wherein the signal output from the differential amplifier unit is the difference compensated by the temperature compensator.

5. The sound reproduction device according to claim 1, further comprising:

a circuit board having the super-directivity loudspeaker and the capacitor mounted thereto; and a temperature sensor disposed to the circuit board, wherein the differential amplifier unit further includes a temperature compensator for compensating the difference output from the differential amplifier based on a temperature detected by the temperature sensor, and wherein the signal output from the differential amplifier unit is the difference compensated by the temperature compensator.

6. The sound reproduction device according to claim 5, wherein the temperature sensor detects temperatures of the super-directivity loudspeaker and the capacitor.

7. The sound reproduction device according to claim 1, further comprising an audible sound source configured to output the audible sound signal.

8. A sound reproduction device comprising:

an ultrasonic wave source for outputting a carrier wave signal in an ultrasonic band;

a modulator having an output terminal for outputting a modulated carrier wave signal obtained by modulating the carrier wave signal with an audible sound signal;

a super-directivity loudspeaker including a piezoelectric element and a diaphragm driven by the piezoelectric element, the piezoelectric element being connected electrically between the output terminal of the modulator and a ground;

a first current detector for detecting a current flowing through the piezoelectric element;

a capacitor connected electrically between the ultrasonic wave source and the ground;

a second current detector for detecting a current flowing through the capacitor;

a high-pass filter for outputting a filtered signal obtained by eliminating a low-frequency band component of the current detected by the first current detector;

a differential amplifier unit including a differential amplifier for outputting a difference between the filtered signal and the current detected by the second current detector, the differential amplifier unit being configured to output a signal corresponding to the output difference;

a first temperature sensor disposed to the super-directivity loudspeaker; and a second temperature sensor disposed to the capacitor, wherein the differential amplifier unit further includes a temperature compensator for compensating the difference output from the differential amplifier based on a temperature detected by the first temperature sensor and a temperature detected by the second temperature sensor, wherein the signal output from the differential amplifier unit is the difference compensated by the temperature compensator, and wherein the ultrasonic wave source is configured to output the carrier wave signal such that the signal output from the differential amplifier unit is constant.

9. A sound reproduction device comprising:

an ultrasonic wave source for outputting a carrier wave signal in an ultrasonic band;

a modulator having an output terminal for outputting a modulated carrier wave signal obtained by modulating the carrier wave signal with an audible sound signal;

a super-directivity loudspeaker including a piezoelectric element and a diaphragm driven by the piezoelectric element, the piezoelectric element being connected electrically between the output terminal of the modulator and a ground;

a first current detector for detecting a current flowing through the piezoelectric element;

a capacitor connected electrically between the ultrasonic wave source and the ground;

a second current detector for detecting a current flowing through the capacitor;

a high-pass filter for outputting a filtered signal obtained by eliminating a low-frequency band component of the current detected by the first current detector;

a differential amplifier unit including a differential amplifier for outputting a difference between the filtered signal and the current detected by the second current detector, the differential amplifier unit being configured to output a signal corresponding to the output difference;

a circuit board having the super-directivity loudspeaker and the capacitor mounted thereto; and a temperature sensor disposed to the circuit board, wherein the differential amplifier unit further includes a temperature compensator for compensating the difference output from the differential amplifier based on a temperature detected by the temperature sensor, wherein the signal output from the differential amplifier unit is the difference compensated by the temperature compensator, and wherein the ultrasonic wave source is configured to output the carrier wave signal such that the signal output from the differential amplifier unit is constant.

10. The sound reproduction device according to claim 9, wherein the temperature sensor detects temperatures of the super-directivity loudspeaker and the capacitor.

* * * * *